United States Patent [19]

Manno

[11] Patent Number: 4,534,319

[45] Date of Patent: Aug. 13, 1985

[54] WOOD BURNING STOVE HEAT EXCHANGER

[76] Inventor: Joseph T. Manno, Box 24, Star Rte., Kane, Pa. 16735

[21] Appl. No.: 589,214

[22] Filed: Mar. 13, 1984

[51] Int. Cl.[3] ..... F22B 5/00

[52] U.S. Cl. ..... 122/15; 122/235 K; 122/353; 122/373; 122/374

[58] Field of Search ..... 122/15, 22, 235 D, 235 J, 122/235 K, 353, 371, 373, 374; 237/18, 19; 126/5, 34

[56] References Cited

U.S. PATENT DOCUMENTS

| | | | |
|---|---|---|---|
| 408,008 | 7/1889 | Fries . | |
| 1,093,195 | 4/1914 | Lockhart | 122/4 A |
| 4,034,738 | 7/1977 | Barber | 126/427 |
| 4,195,617 | 4/1980 | Scopetti et al. . | |
| 4,213,443 | 7/1980 | Morande | 126/5 |
| 4,250,864 | 2/1981 | Bergman | 126/5 |
| 4,257,557 | 3/1981 | Thomasma et al. | 122/373 |

*Primary Examiner*—Carroll B. Dority, Jr.

*Attorney, Agent, or Firm*—Cushman, Darby & Cushman

[57] ABSTRACT

A wood burning stove includes a water circulating grate within the stove fire chamber which includes horizontally extending, vertically spaced, first and second tubular manifolds. Fuel supporting pipes, including bottom portions which define a "V", physically and fluidly interconnect the manifolds. An inlet pipe extends throughout the majority of the length of the bottom manifold, and the top manifold is connected—through a container having a larger cross-sectional area than the cross-sectional area of the manifold—to an outlet. The inlet to and outlet from the manifold are connected up to a hydronic space heating system. The container supports a heat exchanger comprising a finned copper tube, so that the heat exchanger extends generally horizontally and within the first manifold. The heat exchanger is connected up to a domestic hot water supply. The container also supports one or more electric resistance heating coils, which heat liquid within the container in emergency situations.

20 Claims, 4 Drawing Figures

WOOD BURNING STOVE HEAT EXCHANGER

BACKGROUND AND SUMMARY OF THE INVENTION

The invention relates to a wood burning stove (also useful for burning certain types of coal) with a water circulating structure within the stove. The stove according to the present invention is constructed in such a manner that it can efficiently and effectively heat an average three bedroom home, while at the same time providing at least a large part of the heating requirements for a domestic hot water supply. A typical stove according to the present invention could have a peak burn power of about 150,000 BTUs an hour, and transfer that heat into a hydronic space heating system, and (if desired) a domestic hot water supply, such that the exterior walls of the stove remain generally comfortable to the touch.

As is conventional in water circulating stoves, the stove according to the invention includes a plurality of walls defining a fire chamber, with the flue disposed in one of the walls; a door in one of the walls providing access to the fire chamber; and means for circulating water through the fire chamber to heat the water when a fire is burning in the fire chamber. According to the invention, the circulating means include first and second manifolds, which are supported—as by a metal plate defining a wall of the stove opposite the wall containing the door—so that they extend generally horizontally, with the first manifold vertically above the second. A plurality of fuel supporting pipes physically and fluidly interconnect the manifolds. The pipes preferably each include a first, generally horizontally extending, portion connected to the first manifold, a second generally vertical portion connected to the first portion, and a third portion interconnecting the second portion and the second manifold, the third portion disposed at a positive angle with respect to the horizontal. Third portions of the fluid supporting pipes on opposite sides of the second manifold define a "V" configuration.

A liquid inlet is provided to the second manifold, and a liquid outlet is operatively connected to the first manifold. The inlet and outlet are adapted to be operatively connected to a hydronic space heating system for heating areas—such as rooms of a house—remote from the stove itself. The inlet includes an inlet pipe which extends concentrically within the tubular second manifold, a majority of the length thereof.

Defining part of the outlet from the first manifold is a container which has a cross-sectional area significantly greater than the cross-sectional area of the first manifold, with an outlet pipe connected to the container. The container is connected to the metal plate defining the manifold-supporting wall of the stove. The container also supports a heat exchanger, which preferably comprises a thinned copper tube having an inlet and an outlet. The thinned copper tube is supported so that it extends generally horizontally, and extends within, and over a substantial portion of the length of, the first manifold. The heat exchanger is adapted to be connected up to a hot water tank and a conventional domestic hot water supply system.

In order to provide for safe operation of the stove, pressure relief means are associated with the water circulating means to allow release of pressure from the water circulating means should it build up to a pressure greater than a predetermined "safe" value. Also, one or more electric resistance coils are supported by the container, and connected up to a source of EMF, for heating liquid within the container when the stove is to be left unattended for long periods of time in order to prevent freezing of liquid within the water circulating means. The electric resistance coils also provide electrically heated water to a hydronic system.

It is the primary object of the present invention to provide an efficient wood burning, water circulating stove, for providing space heating and/or domestic hot water heating for a dwelling. This and other objects of the invention will become clear from an inspection of the detailed description of the invention, and from the appended claims.

DETAILED DESCRIPTION OF THE DRAWINGS

Figure 1:
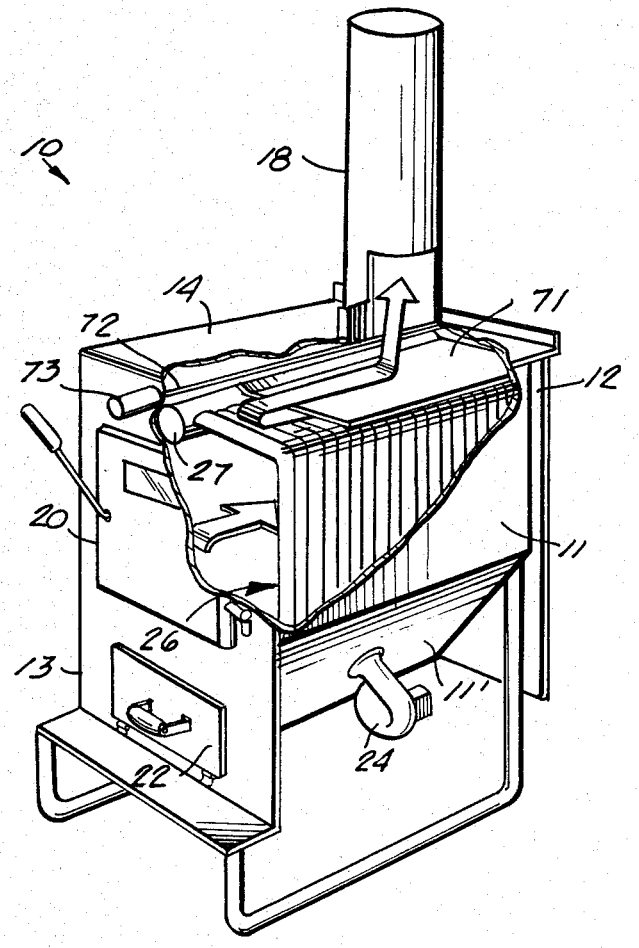
FIG. 1 is a perspective view, with portions of the walls cut away to illustrate interior components, of an exemplary wood burning stove according to the present invention.

A wood or coal burning stove 10 according to the present invention includes, as conventional, a plurality of walls 11, 12, 13, 14, etc., defining a fire chamber. A flue 18 is disposed in one of the walls (preferably the top wall 14), and a door 20 is disposed in one of the walls (preferably the front wall 13) for providing access to the fire chamber. A slidable ash bin 22 is preferably accessible through the front wall 13, and is for facilitating easy removal of ashes which fall to the bottom of the stove 10. Also, a thermostatically controlled fan 24 is mounted by one of the walls—preferably the bottom portion 11' of side wall 11—for supplying combustion air from exteriorly of the stove 10 to the fire chamber so that combustion air is positively and uniformly distributed within the fire chamber to facilitate efficient burning. By adjusting the speed of the fan 24, the rate of air flow—and thus the heat output of the stove—can be readily regulated.

Figure 2:
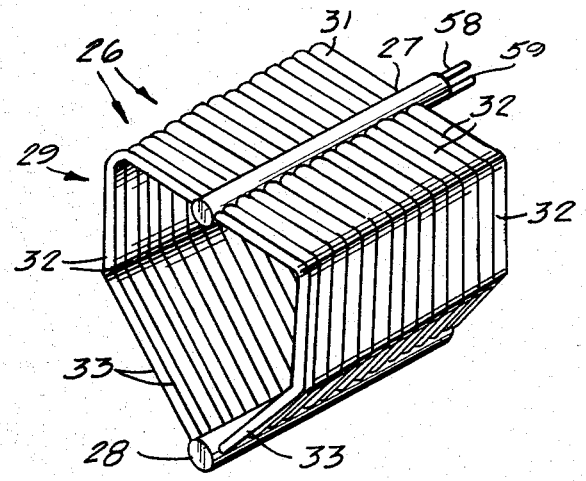
FIG. 2 is a front perspective view of major components of the water circulating grate disposed within the stove of FIG. 1.

The stove 10 further comprises means—including water circulating grate structure 26—for circulating water through the fire chamber to heat the water when a fire is burning in the fire chamber. The means 26—which are most clearly illustrated in FIGS. 2 and 4—comprise first and second manifolds 27, 28, with a plurality of fuel supporting pipes 29 fluidly and physically interconnecting the manifolds 27, 28. For strength and ease of construction, the manifolds 27, 28 are preferably horizontal in cross-section. The walls 11–14, etc., of the stove 10 preferably are constructed of heavy gauge hot-rolled low-carbon steel, or like metal, and the metal plate defining the rear wall 12 (see FIG. 4 in particular) comprises means for supporting the manifolds 27, 28 so that they extend generally horizontally, and are vertically spaced from each other, with the first manifold 27 directly vertically above the second manifold 28.

In addition to the plate 12, other means may be provided for supporting the grate 26. For instance shelves (not shown) extending inwardly from the front wall 13 may engage the bottoms of the manifolds 27, 28.

The fuel supporting pipes 29 preferably comprise steel tubing, each pipe 29 having a first portion 31 thereof which extends generally horizontally, and is directly connected to the first manifold 27 (extending through an opening—not shown—in the first manifold 27 and welded thereat), a second portion 32 which extends generally vertically and connected to the first portion 31, and a third portion 33 which is disposed at a positive angle with respect to the horizontal and interconnects the second portion 32 and the second manifold 28. The portions 31 extend through openings 34 and the second manifold 28, and are welded thereat. As seen most clearly in FIG. 2, the third portions 33 of the pipes 29 on opposite sides of the second manifold 28 define a "V" configuration. This provides for efficient support of the fuel, good liquid flow throughout the system, and facilitates efficient heat transfer in general.

Figure 4:
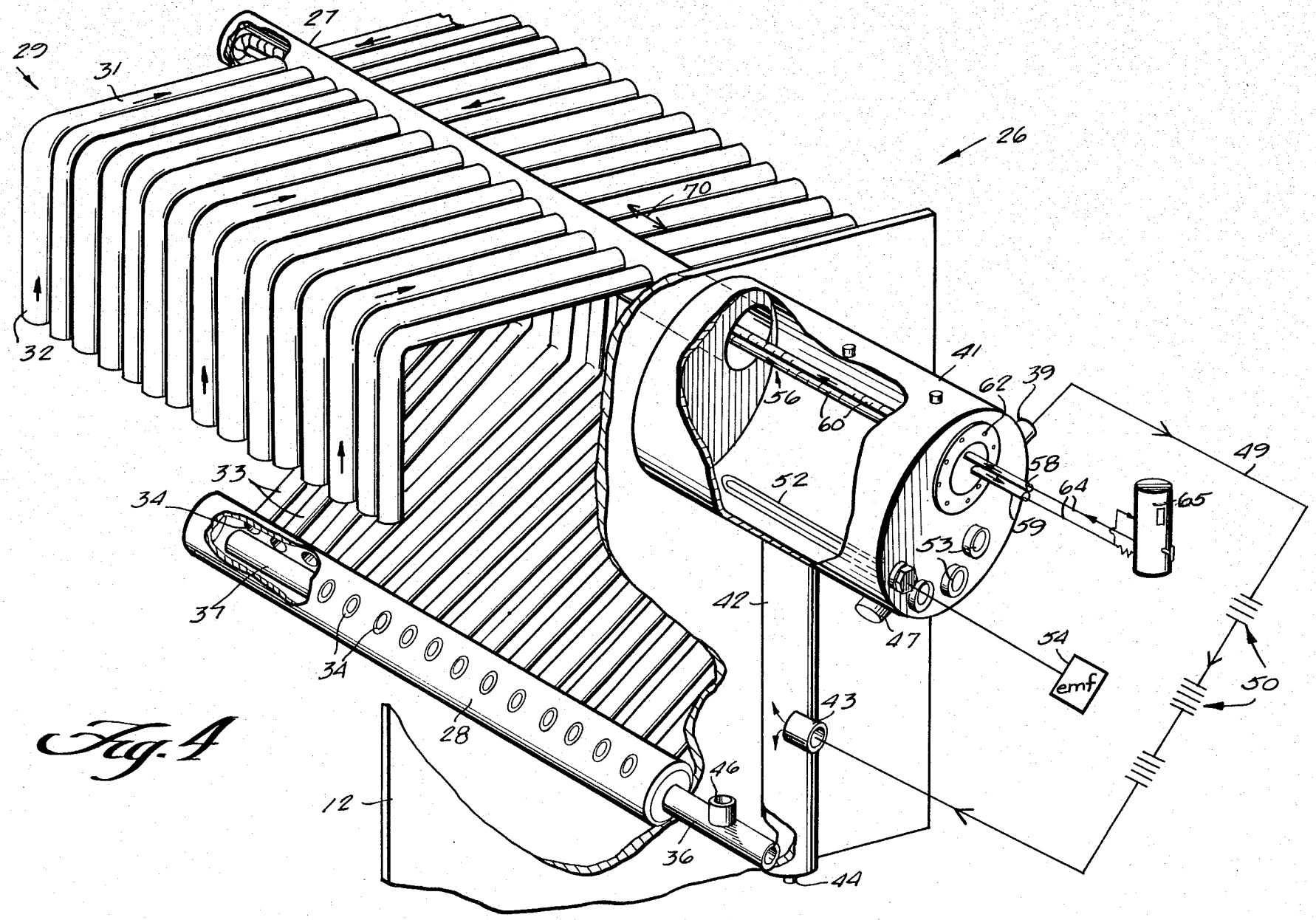
FIG. 4 is a rear perspective view, with portions cut away for clarity of illustration, of the grate of FIG. 4, and schematically illustrating the interconnections of the grate to components of other systems.

Liquid inlet means are provided connected to the second manifold 28, and liquid outlet means are provided connected to the first manifold 27. The liquid inlet means—as illustrated in FIG. 4—preferably take the form of a liquid inlet pipe 36 which is concentric with the second manifold 28. In order to ensure uniform distribution of liquid within the pipes 29, and to prevent shortcircuiting of liquid from the inlet 36 directly to the outlet, the pipe 36 extends a substantial distance—preferably the vast majority of the length of—the manifold 28, having a discharge end 37 thereof at which the liquid is discharged into the manifold 28.

The liquid outlet means operatively connected to the first manifold 27 preferably comprises the outlet pipe section 39, which is physically and fluidly connected to a container 41. The container 41 is preferably circular in cross-section, and its cross-sectional area is significantly greater than the cross-sectional area of manifold 27. The container 41 has a generally horizontal axis, and is preferably welded to the rear of the wall 12, in fluid communication with the manifold 27.

Preferably, a header 42 is physically and fluidly connected to the container 41, as well as to the inlet pipe 36. The header 42 is generally vertically extending, with an inlet conduit 43 connected thereto, and a drain 44 at the bottom thereof.

In order to ensure safe operation of the stove 10, it is highly desirable to provide pressure relief means associated with the water circulating components. For instance such pressure relief means could take the form of the pressure relief members 46, 47 (see FIG. 4), connected to the inlet pipe 36 and the container 41, respectively. The pressure relief means may be of any conventional type, such as fusible plugs, pressure relief valves, or the like, and they may be provided in any desired position within the water circulating system. Should the pressure in the water circulating system get too high (as a result, for example, of obstructed circulation and a very hot fire within the stove), the pressure will be relieved through the means 46, 47, thereby averting damage.

The outlet pipe 39 and the inlet conduit 43 are connected, in use, to a hydronic, space heating system, including conduit 49 and radiators 50. Thus the stove 10 is useful for space heating areas, such as within a dwelling, remote from the stove 10.

In order to prevent freezing of the liquid within the water circulating system during extended periods of non-use, one or more electric resistance heating coils 52 (see FIG. 4) may be mounted within openings 53 formed in container 41. The coils 52 are connected up to a source of e.m.f. 54. The coils 52 can be arranged to operate automatically should the liquid in the container 41 fall below a predetermined value, and the coils heat the liquid within the container 41, which then circulates throughout the grate 26. The coils also are capable of providing enough heat for heating a three bedroom home.

Figure 3:
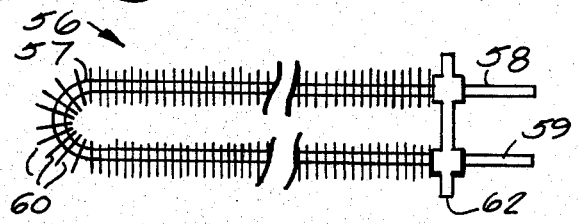
FIG. 3 is a side detailed view of a finned heat exchanger utilizable with the stove of FIG. 1 and adapted to be connected up to a domestic hot water supply.

Another feature of the stove 10 according to the present invention is a provision for allowing the stove to be used for providing at least a large part of the heat for a domestic hot water supply, in addition to space heating functions. This is accomplished by utilizing a heat exchanger 56 (see FIGS. 3 and 4). The heat exchanger 56 preferably comprises an elongated tube 57 the material having high heat conductivity, such as copper. The tube 57 includes an inlet 58 and an outlet 59, and preferably a plurality of fins 60 are provided for facilitating heat transfer between the liquid surrounding the tube 57, and the liquid therewithin. As illustrated in FIG. 4, a plate 62 is received by the container 41 for mounting the heat exchanger 56 so that it extends generally horizontally within the container, and into the first manifold 27. Preferably the heat exchanger extends the majority of the length of the first manifold 27, as can be seen in FIG. 4. The inlet 58 and the outlet 59 are connected up to lines 64, which in turn are connected to the conventional domestic hot water system tank 65.

In order to allow easy start up of a fire within stove 10, while still allowing optimum air flow once combustion is sustained, it is preferable to provide some sort of a movable baffle for directing air flow within the stove 10 with respect to the flue 18. Note that a space 70 (see FIG. 4) is provided between the rear wall 12 and the first of the pipes 29, and during start up air is allowed to flow directly through the space 70 to the flue 18. A movable baffle 71 (see FIG. 1) is mounted for reciprocatory movement above the grate 26, and within the chamber defined by the walls 11–14, etc., the baffle 71 being operatively connected to a rod 72, which is operable by a handle 73 extending outwardly from the front wall 13. The baffle 71 may be mounted by any suitable means—such as shelves, beams, or the like—for reciprocation in a horizontal plane. When the baffle 71 is in the position illustrated in FIG. 1, it closes off the space 70 thus preventing air from flowing directly to the flue 18, and causing the combustion air to flow in the manner indicated by the top arrow in FIG. 1. When the handle 73 is pulled outwardly, the baffle 71 moves forwardly to expose the area 70 and allow direct flow of air therethrough.

A wide variety of other baffles may be utilized for performing the same function as described above, such as the baffle illustrated and described in U.S. Pat. No. 4,195,617.

Operation

The conduits 39, 43 are connected up to the pipe 49 of the hydronic heating system, and the inlet and outlet 58, 59 are connected up to the pipe 64 to the hot water tank 65. The door 20 is opened and wood, or like fuel, is placed within the fire chamber, supported by the pipes 29 (and the lower manifold 28). The handle 73 is pulled forward, and the fire within the stove is lit. Air is supplied by the fan 24.

Once combustion within the stove 10 is sustained, the door 20 is closed and the handle 73 is pushed inwardly. Air flows throughout the fire chamber, and ultimately throughout the flue 18. The fire heats the liquid being introduced through pipe 36 into the lower manifold 28, and by the thermosiphonic effect, the water circulates upwardly through pipes 29 to the upper manifold 27, into the container 41, and out the outlet 39. At the same time water is circulating through the copper tube 57 and is heated by the hot liquid within the upper manifold 27. Thus, at the same time, space heating and domestic hot water heating are provided by the stove 10.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A wood or coal burning stove comprising:

a plurality of walls defining a fire chamber, with a flue disposed in one of said walls;

a door in one of said walls providing access to said fire chamber; and means for circulating liquid through said fire chamber to heat the liquid when a fire is burning in said fire chamber, said means including: a first manifold; a second manifold; means for supporting said first and second manifolds so that they are generally horizontally extending, and vertically spaced from each other, said first manifold above said second manifold; a plurality of fuel supporting pipes physically and fluidly interconnecting said first and second manifolds; a liquid inlet means to said second manifold; a liquid outlet means from said first manifold; and pressure relief means for relieving pressure in said liquid circulating means if it becomes too great;

said inlet means comprising an inlet pipe, said inlet pipe extending generally horizontally and generally concentrically within said second manifold, said inlet pipe entering one end of said manifold and extending all the way to a point adjacent the opposite end of said second manifold at which point it discharges liquid into said manifold.

2. A stove as recited in claim 1 wherein said outlet means comprises a container having a cross-sectional area significantly larger than the cross-sectional area of said first manifold, and in fluid communication with said first manifold, and a liquid outlet pipe physically and fluidly connected to said container.

3. A stove as recited in claim 2 further comprising at least one electric heating coil operatively disposed within said container for, upon energization, heating liquid within said container.

4. A stove as recited in claim 2 further comprising a heat exchanger comprising a pipe of high heat conductivity material, and including a liquid inlet and a liquid outlet distinct from said liquid inlet means to said second manifold and liquid outlet means from said first manifold, said container mounting said heat exchanger so that it extends generally horizontally within said container, and in, and substantially concentric with, said first manifold.

5. A stove as recited in claim 2 further comprising a header, said header fluidly and physically connected to said liquid inlet means to said second manifold, and to said container, and having a drain at a bottom portion thereof.

6. A stove as recited in claim 1 wherein said liquid inlet means and said liquid outlet means are operatively connected to a hydronic heating system for heating areas remote from said stove by circulating liquid heated by said stove therethrough.

7. A stove as recited in claim 1 wherein said means for supporting said manifolds so that they extend generally horizontally and are vertically spaced from each other comprises a metal plate defining a wall of said stove, opposite said wall having said door therein.

8. A wood or coal burning stove comprising:

walls defining a fire chamber, with a flue disposed in one of said walls;

a door in one of said walls providing access to said fire chamber;

means for circulating liquid through said fire chamber to heat the liquid when a fire is burning in said fire chamber, said means comprising: a manifold; a plurality of fuel supporting pipes physically and fluidly connected to said manifold; means for operatively connecting said manifold and pipes to a hydronic system for space heating of areas remote from said stove; and a heat exchanger comprising a finned pipe including an inlet and an outlet, said heat exchanger mounted so that it is substantially concentric with, and extends a substantial length within, said manifold, said inlet to and outlet from said heat exchanger adapted to be operatively connected to a water tank of a domestic hot water supply.

9. A stove as recited in claim 8 wherein said means for connecting said manifold to a hydronic system include a container having a cross-sectional area significantly larger than the cross-sectional area of said manifold, said container in fluid communication with said manifold and said container mounting said heat exchanger.

10. Apparatus as recited in claim 9 further comprising at least one electric resistance coil mounted within said container and operatively connected to a source of e.m.f., said coil, when energized, heating liquid within said container.

11. A wood or coal burning stove comprising:

walls defining a fire chamber, with a flue disposed in one of said walls;

a door in one of said walls providing access to said fire chamber;

means for circulating liquid through said fire chamber to heat the liquid when a fire is burning in said fire chamber, said means comprising: a manifold; and a plurality of fuel supporting pipes physically and fluidly connected to said manifold;

means for operatively connecting said manifold and pipes to a hydronic system for space heating of areas remote from said stove;

means for mounting said manifold so that it extends generally horizontally, said means comprising a metal plate defining the wall of said fire chamber opposite said wall having said door therein; and said means for operatively connecting said manifold to a hydronic system including a container having a cross-sectional area significantly greater than the cross-sectional area of said manifold, said container physically connected to said metal plate and in fluid communication with said manifold.

12. Apparatus as recited in claim 11 further comprising at least one electric resistance coil mounted within said container and operatively connected to a source of e.m.f., said coil, when energized, heating liquid within said container.

13. A stove as recited in claim 11 wherein said manifold comprises a first manifold; and wherein said means for circulating liquid further comprises a second manifold disposed below, and generally parallel to, said first manifold, said metal plate supporting said second manifold; and wherein said plurality of fuel supporting pipes each include a first, generally horizontally extending portion connected to said first manifold, a second, generally vertically extending portion connected to said first portion, and a third portion connected between said second portion and said second manifold, and defining a positive angle with respect to the horizontal, said fuel supporting pipes physically and fluidly connected to said first and second manifolds on either side thereof, and said third sections of said pipes on opposite sides of said second manifold defining a "V".

14. A wood or coal burning stove comprising:

a plurality of walls defining a fire chamber, with a flue disposed in one of said walls;

a door in a first wall, of one of said walls, providing access to said fire chamber;

two of said walls, second and third walls, on opposite sides on said first wall, comprising side walls, said second wall having a slanted bottom portion;

means for circulating liquid through said fire chamber to heat the liquid when a fire is burning in said fire chamber, said means including: a first manifold; a second manifold, means for supporting said first and second manifolds so that they are generally horizontally extending, and vertically spaced from each other, said first manifold above said second manifold; a plurality of fuel supporting pipes physically and fluidly interconnecting said first and second manifolds; a liquid inlet means to said second manifold; and a liquid outlet means from said first manifold; and a fan mounted to said second wall slanted portion, and positioned for effecting forced air circulation from the exterior of said stove to the volume surrounding said fire chamber to support combustion, the air flowing in a path from below said fuel supporting pipes through the volume between said pipes.

15. A wood or coal burning stove comprising:

a plurality of walls defining a fire chamber, with a flue disposed in one of said walls;

a door in one of said walls providing access to said fire chamber; and means for circulating liquid through said fire chamber to heat the liquid when a fire is burning in said fire chamber, said means including: a first manifold; a second manifold; means for supporting said first and second manifolds so that they are generally horizontally extending, and vertically spaced from each other, said first manifold above said second manifold; a plurality of fuel supporting pipes physically and fluidly interconnecting said first and second manifolds; a liquid inlet means to said second manifold; and a liquid outlet means from said first manifold;

said plurality of fuel supporting pipes each including a first, generally horizontally extending portion connected to said first manifold, a second, generally vertically extending portion connected to said first portion, and a third portion connected between said second portion and said second manifold, and defining a positive angle with respect to the horizontal, said fuel supporting pipes physically and fluidly connected to said first and second manifolds on either side thereof, and said third sections of said pipes on opposite sides of said second manifold defining a "V".

16. A wood or coal burning stove comprising:

a plurality of walls defining a fire chamber, with a flue disposed in one of said walls;

a door in one of said walls providing access to said fire chamber;

means for circulating liquid through said fire chamber to heat the liquid when a fire is burning in said fire chamber, said means including: a first manifold; a second manifold; means for supporting said first and second manifolds so that they are generally horizontally extending, and vertically spaced from each other, said first manifold above said second manifold; a plurality of fuel supporting pipes physically and fluidly interconnecting said first and second maniofolds, a liquid inlet means to said second manifold; a liquid outlet means from said first manifold; and pressure relief means for relieving pressure in said liquid circulating means if it becomes too great; and a generally horizontally extending heat exchanger disposed within said first manifold and extending a substantial distance therewithin, said heat exchanger including a liquid inlet and a liquid outlet, said liquid inlet and outlet being distinct from said liquid inlet means to said second manifold and liquid outlet means from said first manifold.

17. A stove as recited in claim 16 wherein said heat exchanger comprises a finned pipe of high heat conductivity material, such as copper.

18. Apparatus as recited in claim 14 wherein said plurality of fuel supporting pipes each include a first, generally horizontally extending portion connected to said first manifold, a second, generally vertically extending portion connected to said first portion, and a third portion connected between said second portion and said second manifold, and defining a positive angle with respect to the horizontal, said fuel supporting pipes physically and fluidly connected to said first and second manifolds on either side thereof, and said third sections of said pipes on opposite sides of said second manifold defining a "V".

19. Apparatus as recited in claim 18 wherein said manifolds comprise tubes which are circular in cross-section.

20. A stove as recited in claim 16 wherein said liquid inlet means and said liquid outlet means are operatively connected to a hydronic heating system for heating areas remote from said stove by circulating liquid heated by said stove therethrough; and wherein said inlet to and outlet from said heat exchanger are operatively connected to a domestic hot water tank.

* * * * *